US007001182B2

(12) United States Patent
Lazecki et al.

(10) Patent No.: US 7,001,182 B2
(45) Date of Patent: Feb. 21, 2006

(54) METHOD AND DEVICE FOR SIMULATING DETONATING PROJECTILES

(75) Inventors: René Lazecki, Kirchdorf (CH); Roland Luethi, Moosseedorf (CH); Adrian Balmer, Laupen (CH)

(73) Assignee: Business Park Bern AG, (CH)

( * ) Notice: Subject to any disclaimer, the term of this patent is extended or adjusted under 35 U.S.C. 154(b) by 0 days.

(21) Appl. No.: 09/996,211

(22) Filed: Nov. 28, 2001

(65) Prior Publication Data

US 2002/0064760 A1 May 30, 2002

(30) Foreign Application Priority Data

Nov. 29, 2000 (CH) ..... 2313/00

(51) Int. Cl.
*F41A 33/00* (2006.01)

(52) U.S. Cl. ..... 434/11; 434/15; 434/21; 434/22

(58) Field of Classification Search ..... 434/11–27
See application file for complete search history.

(56) References Cited

U.S. PATENT DOCUMENTS 3,927,480 A * 12/1975 Robertsson ..... 434/22
4,273,536 A * 6/1981 Wick ..... 434/14
4,478,581 A * 10/1984 Goda ..... 434/22
4,640,514 A * 2/1987 Myllyla et al. ..... 463/51
4,682,953 A * 7/1987 Doerfel et al. ..... 434/16
4,752,226 A * 6/1988 Akers et al. ..... 434/11
5,228,854 A * 7/1993 Eldridge ..... 434/11
5,382,958 A * 1/1995 FitzGerald ..... 342/386

(Continued)

FOREIGN PATENT DOCUMENTS

DE 3113068 12/1982
DE 19617060 11/1997

(Continued)

*Primary Examiner*—Xuan M. Thai
*Assistant Examiner*—Cameron Saadat
(74) *Attorney, Agent, or Firm*—Ostrolenk, Faber, Gerb & Soffen, LLP

(57) ABSTRACT

Detonating projectiles are fired into a target area by a weapon, the time between firing and detonation being one second or less. By setting the target location at the same distance as e.g. the edge (1) of a building (3), however laterally displaced with respect to that edge, it is possible to obtain an effect also in an area invisible to the bearer of the weapon. For simulating this weapon, for example in house-to-house fighting, it is proposed to affix devices (5) comprising a sensor (22) and a transmitter (27) to obstacles. When the weapon is fired, a simulation device provided on the weapon transmits a firing signal to the sensor (22), the latter activating the transmitter (27). Similarly to the real effect of the weapon, the transmitter (27) emits an impact signal in the impact area (7) which also includes the mentioned area which is invisible to the bearer of the weapon. On account of the independent operation of the transceiver unit (5), it is possible to simulate the effect of this weapon substantially without delay as compared to reality.

20 Claims, 2 Drawing Sheets

U.S. PATENT DOCUMENTS

| | | | | |
|---|---|---|---|---|
| 5,474,452 | A * | 12/1995 | Campagnuolo | 434/11 |
| 5,571,018 | A * | 11/1996 | FitzGerald | 434/16 |
| 5,788,500 | A | 8/1998 | Gerber | 434/22 |
| 5,914,661 | A * | 6/1999 | Gross | 340/600 |
| 5,980,254 | A * | 11/1999 | Muehle et al. | 434/11 |
| 6,254,394 | B1 * | 7/2001 | Draper et al. | 434/11 |
| 6,450,817 | B1 * | 9/2002 | Deinlein | 434/16 |
| 6,579,097 | B1 * | 6/2003 | Sampson et al. | 434/21 |
| 6,599,127 | B1 * | 7/2003 | Hopmeier et al. | 434/16 |

FOREIGN PATENT DOCUMENTS

| | | |
|---|---|---|
| DE | 19803337 | 8/1999 |
| DE | 19915222 | 10/2000 |
| EP | 0668481 | 8/1995 |
| EP | 0809083 | 11/1997 |
| WO | 9930103 | 6/1999 |

* cited by examiner

METHOD AND DEVICE FOR SIMULATING DETONATING PROJECTILES

FIELD OF THE INVENTION

The present invention refers to a method for simulating the effect of exploding projectiles fired by weapons. Furthermore, the invention refers to a device for carrying out a method for simulating the effect of exploding projectiles fired by weapons.

BACKGROUND OF THE INVENTION

Known types of detonating projectiles are those fired by ballistic weapons (mortars, artillery). For simulation purposes, the trajectory and the location of the detonation are calculated on the basis of the gun orientation and other parameters. Due to the relatively long time of flight of several seconds, this calculation can be performed by a central computer.

Recently, however, infantry weapons have been introduced which also operate according to this principle. These weapons are essentially similar to rifles. The soldier takes aim at the edge of a building, for example, thereby allowing the targeting device to determine the corresponding distance and store it. Then the soldier aims past the edge and fires. The shot travels the previously determined distance and detonates at the end thereof, or at some distance before or behind it. Essentially, it is thereby possible to hit a target behind the aimed edge, or, in simple terms, to shoot to a certain extent "around the corner".

Since in particular the time of flight is for this kind of weapon rather in the range of milliseconds, it is not possible to simulate the effect of this weapon by a central computer without admitting an unrealistic delay between the firing and its effect.

SUMMARY OF THE INVENTION

It is therefore an object of the present invention to provide a method and a device for simulating the effect of detonating projectiles which allows realistically short delays between firing and detonation at the target location.

According to a first aspect of the invention this object is attained by a method wherein a weapon signal emitted by the weapon when fired is detected by a sensor located near the target area and the sensor prompts at least one associated transmitter to emit an impact signal which is adapted to cover also that portion of the impact area of the simulated explosion which cannot be covered by the weapon signal of the weapon.

According to a second aspect of the invention there is provided a device which comprises a sensor and a transmitter. The sensor is effectively linked to the transmitter in such a manner that a weapon signal which is detected by the sensor and which indicates the simulated firing of a projectile having an explosive effect in the target area prompts the emission of an impact signal in the impact area of the simulated projectile by the transmitter.

According to a third aspect of the invention in a device according to the second aspect, the sensor is directionally sensitive and preferably comprises a plurality of sensor elements each of which covers a sector of the total angular range covered by the sensor in order to determine the stepwise angle of incidence of the weapon signal emitted by the weapon at least stepwise. The transmitter is adapted to emit the impact signal with a directionally variable range. It particularly comprises a plurality of transmitter elements each adapted to supply approximately a sector with a controllable range. The transmitter is adapted for being triggered by the sensor according to the angle of incidence of the weapon signal of the weapon in such a manner that the area supplied with an effective impact signal by the transmitter represents an improved approximation to the impact area of a projectile exploding in reality.

The principal aspect of the method according to the invention is that firing information emitted by the simulated weapon is locally detected and emitted in the impact area of the simulated detonation, i.e. particularly also in the area which is invisible from the position of the shooter. Preferably, a transceiver unit is provided on the obstacle for this purpose. The receiver of this unit records information emitted by the weapon that the shot has been fired and activates the transmitter unit which emits information on the simulated detonation in the impact area. Participants in the exercise who are present in the impact area and equipped with corresponding receivers are thus informed of the fact that they have been hit and are eliminated or considered as injured.

According to a preferred embodiment, the direction from which the weapon is pointed at the obstacle is furthermore determined in order to be able to demarcate the impact area of the detonation more precisely. In this case it is further preferred that the transmitter also offers the possibility of selectively supplying the impact signal to certain portions of the possible impact area only.

BRIEF DESCRIPTION OF THE DRAWINGS

The invention will be explained in more detail with reference to an exemplary embodiment illustrated in the figures.

DESCRIPTION OF THE PREFERRED EMBODIMENT

Figure 1:
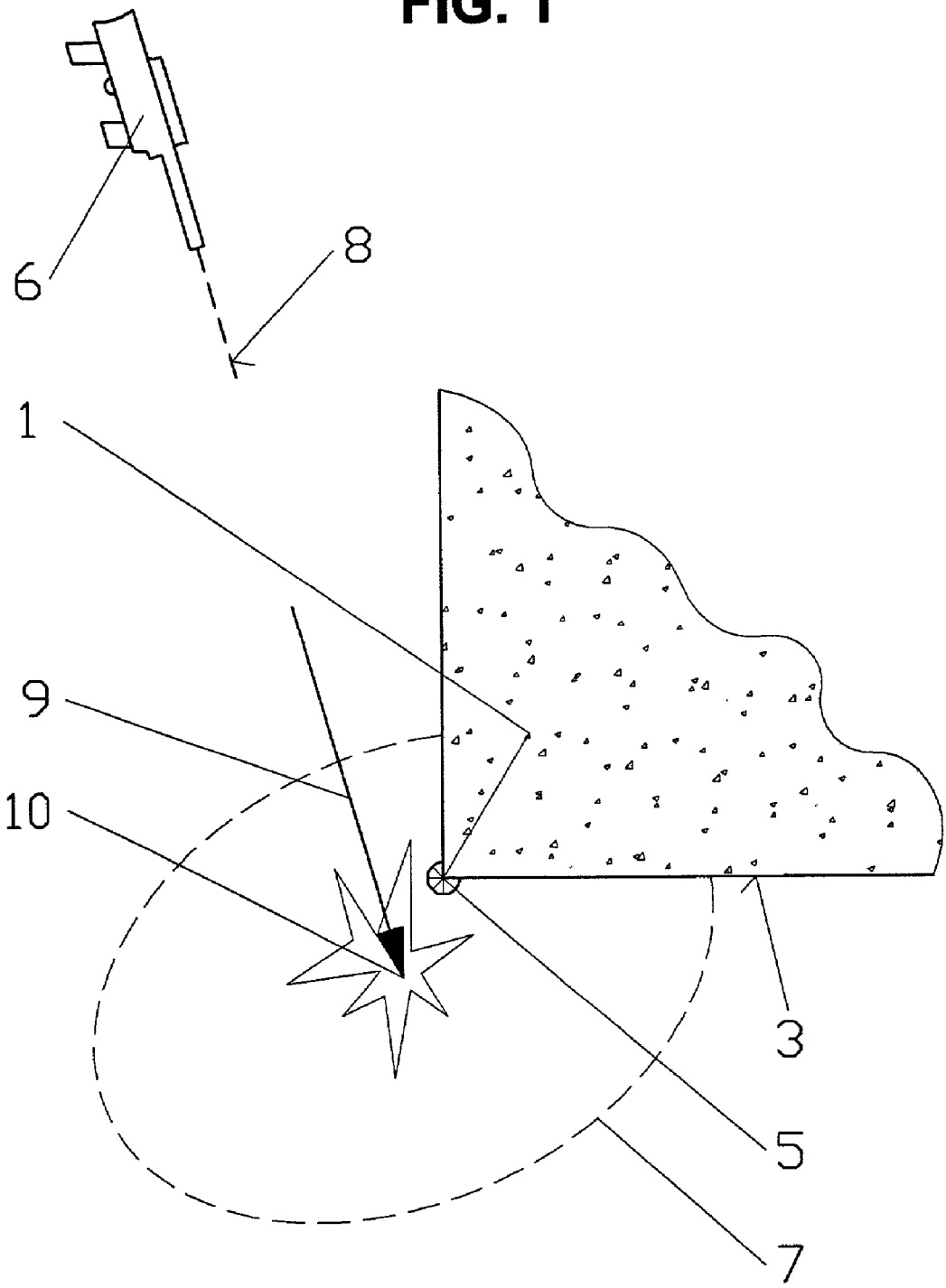
FIG. 1 schematically shows a simulation situation including a weapon and a target area.

According to the illustrated embodiment of the invention, a transceiver unit 5 is affixed to the edge 1 of a schematically illustrated building 3. Any other type of target area may be used. It is noted that the size of transceiver unit 5 is shown in FIG. 1 in an exaggerated manner compared to simulated impact area 7 of the detonation.

The purpose of the simulation is to simulate the effect of a projectile fired from simulated weapon 6 approaching on trajectory 9 and detonating at location 10. It is assumed in an idealizing manner that the impact of the explosion at location 10 covers area 7, wherein trajectory 9 is flat. The simulation requires that the corresponding weapon 6 is provided with a device allowing the emission of firing information into the area visible from the weapon. Generally, this would be a simulation device in the weapon 6 using a laser source. Known embodiments of such devices are already capable of compensating elevation and lead by projecting the laser beam into the target area with a lateral and/or vertical deviation. For explosive projectiles and other applications, it is known that the laser device sweeps a larger part of the target area, i.e. that the laser beam is guided over a determined surface in a zigzag movement, for example, thereby activating detectors provided in equipment and on training participants in the impact area.

In the case of the weapon for which the simulation is intended, at first, edge 1 is targeted. The laser beam 8 of the weapon 6 hits transceiver unit 5. If necessary, the receiver of the unit is thereby set to an alarm condition. The receiver is directionally sensitive in order to be able to determine the direction of trajectory 9 at least approximately. Furthermore, the transceiver unit comprises a reflector device 20 which reflects the laser beam back onto itself. This allows the targeting device, here the laser source in the weapon to detect that its beam has hit a transceiver unit 5. Subsequently, as the weapon is pointed at target location 10, the targeting device may deviate the laser beam with respect to the orientation of the weapon or expand it in such a manner that it still hits transceiver unit 5.

When the weapon is fired, a corresponding piece of information is transmitted by the laser beam to the receiver of the transceiver unit. This will activate the transmitter section 27 of transceiver unit 5, which in turn will emit the impact signal in impact area 7. In the example shown in FIG. 1 it is assumed that impact area 7 represents essentially an ellipse whose longer axis is perpendicular to trajectory 9. Equipment and/or simulation participants present in impact area 7 and carrying detectors responding to the signal of the transmitter of transceiver unit 5 are thus immediately after the firing informed of the fact that they are exposed to the impact of this weapon by the activation of their sensors.

In other words, transceiver unit 5 transforms the hit signal emitted by the simulation device of the weapon into an impact signal that covers impact area 7, i.e. also locations which cannot be attained by the hit signal of the weapon itself for physical reasons.

Figure 2:
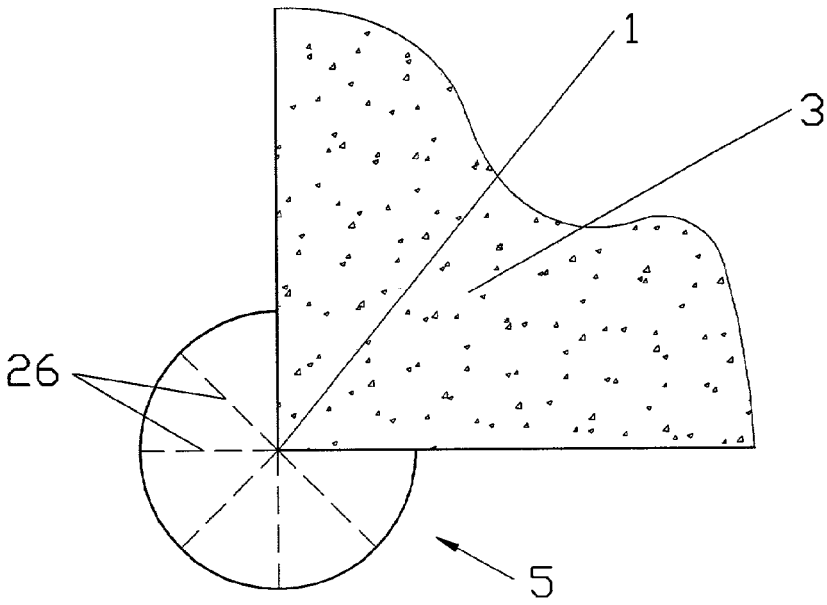
FIG. 2 shows an enlarged top view of a transceiver unit.
Figure 3:
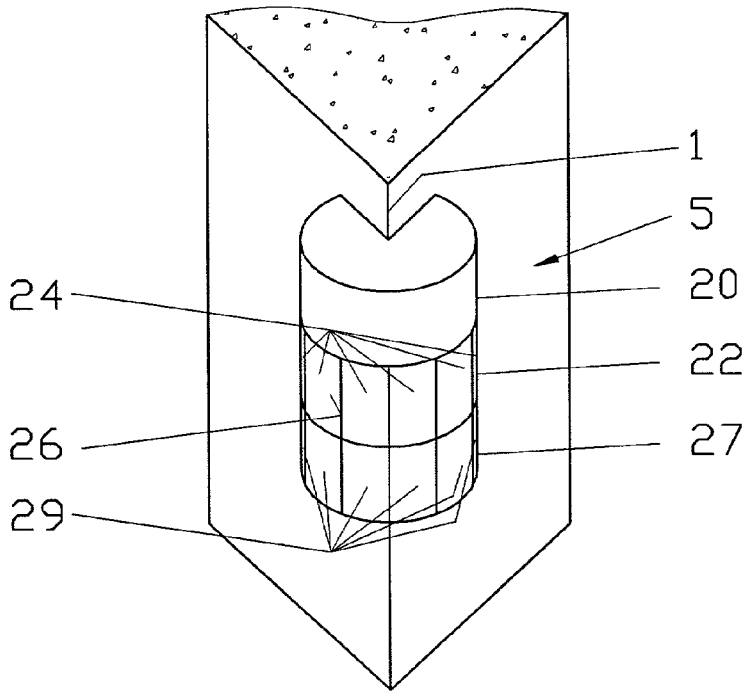
FIG. 3 shows a front view of a transceiver unit.

FIGS. 2 and 3 show transceiver unit 5 on a greatly enlarged scale. It comprises essentially three sections. Reflector section 20 is arranged at the top and serves for reflecting an effective portion of the laser signal emitted by the weapon back onto itself, thereby allowing the weapon to locate transceiver unit 5.

Sensor 22 is arranged in the center. It is comprised of a number of sensor elements 24, each of which surveys a sector. For example, the arrangement of FIG. 2 allows the determination of the horizontal (virtual) trajectory 9 with a resolution of 45 degrees. Sensor elements 24 may be usual photo-sensitive elements which are separated from each other by separating walls 26 in order to ensure the sector-shaped directional characteristic.

Transmitter 27 is arranged at the bottom of transceiver unit 5. It comprises a number of transmitter elements 29, each of which approximately covers a respective sector of the area surrounding the transceiver unit. Each transmitter element comprises a laser light source, preferably a laser diode, capable of emitting a respective impact signal in the form of light laser. Furthermore, a control system of the transceiver unit 5 also controls the transmitting power of each of the transmitter elements 29 in order to control the range of the impact signal emitted by the transmitter elements each of which may therefore be respectively different and thereby to reproduce the shape of impact area 7.

The control both of the simulation device of the weapon and of transceiver unit 5 can be realized by conventional means. For example, each sensor may be connected to a threshold amplifier which responds when a signal is received and ensures that each transmitter element is supplied with a certain amount of energy whereby the range (distance) of the impact signal in the corresponding direction is adjusted. The resulting shape of the reproduced impact area 7 corresponds to the orientation of the respective sensor element 24 and thus to that of trajectory 9.

Control devices for this purpose are known to those skilled in the art and therefore need not be explained in more detail.

An alternative possibility of controlling transceiver unit 5 consists in providing the respective building 3 with a sufficiently powerful simulation computer which detects the weapons, particularly of the simulated type, that are monitored by the transceiver units and possibly fired only near the house and activates the corresponding transmitter units 20. With this arrangement, it is additionally possible to provide further transmitter units which are not integrated in the transceiver units, and/or to inform participants or equipment of their location in the impact area, e.g. by radio. Since this local computing unit may basically also be informed of the position and the number of all nearby participants, equipment, and weapons, it may simulate the application of the weapons, complementarily with the local transceiver units 5, even if they are not used for their actual purpose, e.g. for direct fire which may not be recognized by transceiver units 5 in certain circumstances. However, as the case may be, a certain delay and thus a less realistic simulation of the impact may be the result.

On the basis of the preceding description of a preferred embodiment, it will be understood by those skilled in the art that various modifications can be made without departing from the scope of the invention as defined by the claims. For example if the requirements are less stringent, it is possible to omit the directional sensitivity of transmitter 27 as well as of sensor 22. If the range control and particularly also the directional characteristic of transmitter 27 are omitted, an essentially circular impact area surrounding the transceiver unit will be the simulated. Even if the lack of any directional characteristic of the sensor unit might possibly be acceptable, the transceiver unit would then be incapable of discerning whether the special weapon is used as intended or whether it is e.g. aimed at the obstacle directly. A correct application of the weapon would then be assumed in every case.

Instead of light (laser), other means of data transmission could be considered, such as e.g. ultrasonic or radio signals, particularly of a high frequency, e.g. 2.4 GHz. However, in general, the latter are less suitable on account of their sensitivity to certain atmospheric conditions which would not substantially influence the course of the simulation otherwise.

Further possible modifications are:

- Displaceable separating walls 26 between transmitter elements which are positioned according to the trajectory in such a manner as to allow a better reproduction of the impact area by the transmitter elements;
- The sections of a transceiver unit (reflector, sensor, transmitter) are in the form of separate parts, so as to allow particularly the transmitter to be positioned for optimum signal emission and/or to be addressed by a plurality of sensor/reflector units;
- A 360° detection range of the transceiver unit in order to be mounted on a vehicle or another obstacle and to be able to simulate fire onto the obstacle from any direction and an impact behind the obstacle;
- An additional effect unit for producing realistic effects such as smoke, explosion noise, light flashes.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for simulating the effect of an exploding projectile fired by a weapon in a simulated impact area that would be affected by the exploding projectile, the method comprising:

emitting a weapon signal from the weapon toward a target area, wherein the weapon signal defines a first portion of the simulated impact area less than the entire simulated impact area;

locating a sensor near the target area and detecting the weapon signal by the sensor located near the target area;

transmitting an impact signal from a transmitter operatively linked to the sensor when the weapon signal is sensed by the sensor and causing the transmitted impact signal to cover the first portion of the simulated impact area and a second portion of the simulated impact area which is at least partially outward of the first portion thereby simulating the effect of a simulated detonation of a projectile fired by the weapon.

2. The method of claim 1, further comprising determining the trajectory of a simulated projectile fired by the weapon based on the angle of incidence of the weapon signal on the sensor;

modifying the impact signal directionally for approximating the area covered by the impact signal to simulate the impact area of detonation of a real projectile near the target area.

3. A device for simulating the effect of an exploding projectile fired by a weapon toward a target area, wherein the weapon comprises:

a weapon signal emitter to emit a weapon signal, wherein the weapon fires in a simulated impact area that would be affected by the exploding projectile, and wherein the weapon signal defines a first portion of the simulated impact area less than the entire simulated impact area;

the device comprising:

a sensor located near the target area and which senses the weapon signal from the weapon and indicates the simulated firing of a projectile with an explosive effect in the target area;

a transmitter operatively linked to the sensor, the transmitter emits an impact signal in response to the sensed weapon signal, wherein the impact signal covers the first portion of the simulated impact area and a second portion of the simulated impact area which is at least partially outward of the first portion.

4. The device of claim 3, wherein the sensor is directionally sensitive and senses the direction from which the weapon signal is received;

the transmitter linked to the sensor emits the impact signal with a directionally variable range, wherein the transmitter is triggered by the sensor according to an angle of incidence of the weapon signal of the weapon in such a manner that the area supplied with an effective impact signal by the transmitter approximates the impact area an exploding projectile.

5. The device of claim 4, wherein the sensor senses the weapon signal over a total angular range, the sensor comprises a plurality of sensor elements, each sensor element covering a sector of the total angular range covered by the sensor for enabling the sensor to determine the angle of incidence of the weapon signal emitted by the weapon dependent upon the sensor elements on which the weapon signal is incident.

6. The device of claim 5, wherein the transmitter comprises a plurality of transmitter elements, each transmitter element supplies approximately a respective sector having a controllable range over a respective part of the simulated impact area and adjusts the range of the impact signal in the corresponding direction, the transmitter elements being operatively connected with the sensor, so that each transmitter element is triggered by the sensor according to the angle of incidence of the weapon signal.

7. The device of claim 3, further comprising a reflector which reflects at least an effective portion of the weapon signal back to the weapon.

8. The device of claim 7, wherein the reflector and the weapon are positioned so that the signal from the weapon is reflected by the reflector back to the weapon, and the weapon emits a weapon signal to be transmitted to the sensor by firing of the weapon.

9. The device of claim 3, further comprising a weapon spaced from the sensor the weapon emitting the weapon signal toward the sensor.

10. The device of claim 9, wherein the sensor is responsive to laser light and the weapon includes a device for emitting the weapon signal in the form of laser light toward the sensor.

11. The device of claim 3, wherein the sensor is responsive to laser light.

12. The device of claim 3, wherein the transmitter comprises at least one laser light source and the laser light source of the transmitter emits an impact signal in the form of laser light.

13. The device of claim 3, wherein the sensor is sensitive to high frequency radio signals or ultrasonic signals.

14. The device of claim 13, wherein the transmitter is adapted to emit an impact signal in the form of a high frequency radio signal or an ultrasonic signal.

15. The device of claim 3, wherein the transmitter is adapted to emit an impact signal in the form of a high frequency radio signal or an ultrasonic signal.

16. A device for simulating the effect of exploding projectiles fired by a weapon toward a target area, the device comprising;

a sensor located near the target area and which senses the weapon signal from the weapon;

a transmitter operatively linked to the sensor such that the weapon signal indicating the simulated firing of a projectile with an explosive effect in the target area is sensed by the sensor which operates the transmitter to emit an impact signal over a simulated impact area of the simulated projectile;

wherein the sensor is directionally sensitive and senses the direction from which the weapon signal is received, and the transmitter is linked to the sensor and emits the impact signal with a directionally variable range and wherein the transmitter is triggered by the sensor according to an angle of incidence of the weapon signal of the weapon in such a manner that the area supplied with an effective impact signal by the transmitter approximates the simulated impact area of an exploding projectile, the sensor senses the weapon signal over a total angular range, the sensor comprises a plurality of sensor elements, each sensor element covers a sector of the total angular range covered by the sensor for enabling the sensor to determine the angle of incidence of the weapon signal emitted by the weapon dependent upon the sensor elements on which the weapon signal is incident, and the transmitter comprises a plurality of transmitter elements, each transmitter element being adapted to supply approximately a respective sector having a controllable range over a respective part of the simulated impact area and each of the transmitter elements being connected with at least one of the plurality of sensor elements each for a particular sector so that each transmitter element is triggered by the at least one sensor element according to the angle of incidence of the weapon signal.

17. A device for simulating the effect of exploding projectiles fired by a weapon toward a target area, the device comprising;

a sensor located near the target area and which senses weapon signal from the weapon;

a transmitter operatively linked to the sensor such that the weapon signal indicating the simulated firing of a projectile with an explosive effect in the target area sensed by the sensor operates the transmitter to emit an impact signal over a simulated impact area of the simulated projectile; and screens at the transmitter separating the transmitter into transmitter elements for providing an essentially sectorial restriction of the impact signal emitted by the transmitter elements, wherein the sensor is directionally sensitive and adapted to sense the direction from which the weapon signal is received and wherein the transmitter connected with the sensor is operable to emit the impact signal with a directionally variable range, so that the transmitter is triggered by the sensor according to an angle of incidence of the weapon signal of the weapon in such a manner that the area supplied with an effective impact signal by the transmitter approximates the impact there of an exploding projectile, wherein the sensor senses the weapon signal over a total angular range, the sensor comprises a plurality of sensor elements, each sensor element covering a sector of the total angular range covered by the sensor for enabling the sensor to determine the angle of incidence of the weapon signal emitted by the weapon dependent upon the sensor elements on which the weapon signal is incident, and wherein the transmitter comprises a plurality of transmitter elements, each transmitter element supplying approximately a respective sector having a controllable range over a respective part of the impact area and each of the transmitter elements being connected with at least one of the plurality of sensor elements each for a particular sector so that each transmitter element is triggered by the at least one sensor element according to the angle of incidence of the weapon signal.

18. The device of claim 17, wherein the screens of the transmitter comprise separating walls between the transmitter elements.

19. The device of claim 18, wherein the screens between the transmitter elements are adjustable in the function of angle of incidence of the weapon signal received on the sensor for allowing adaptation of the area covered by the impact signal of each of transmitter elements to the impact area of an exploding projectile.

20. An installation for simulating combat action comprising at least one obstacle in the line of sight of an entire impact area of a projectile, the obstacle having a periphery;

a device for simulating the effect of exploding projectiles fired by a weapon toward a target area, the device comprising:

a sensor located near the target area sensing a weapon signal from the weapon, wherein the weapon signal defines a first portion of the impact area less than the entire impact area;

a transmitter operatively linked to sensor that emits an impact signal over the impact area in response to the sensed weapon signal, wherein the impact signal covers the first portion of the impact area and a second portion of the impact area which is at least partially outward of the first portion;

the device being located at the periphery of the obstacle positioned for allowing simulation of the effect of a weapon fired projectile exploding at target location near the device.

* * * * *

UNITED STATES PATENT AND TRADEMARK OFFICE

CERTIFICATE OF CORRECTION

PATENT NO. : 7,001,182 B2
APPLICATION NO. : 09/996211
DATED : February 21, 2006
INVENTOR(S) : René Lazecki, Roland Luethi and Adrian Balmer It is certified that error appears in the above-identified patent and that said Letters Patent is hereby corrected as shown below:

In the claims:

column 6, line 22 should read:

...from the sensor the weapon emitting column 8, line 27:

...the target area and sensing a weapon column 8, line 32:

...operatively linked to the sensor that emits column 8, line 40:

...projectile exploding at the target location near

Signed and Sealed this

Fifteenth Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 7,001,182 B2
APPLICATION NO. : 09/996211
DATED : February 21, 2006
INVENTOR(S) : Rene Lazecki, Roland Luethi and Adrian Balmer It is certified that error appears in the above-identified patent and that said Letters Patent is hereby corrected as shown below:

Title Page: should read
(73) Assignee: Ruag Electronics

Signed and Sealed this

Twenty-first Day of August, 2007

JON W. DUDAS
*Director of the United States Patent and Trademark Office*